United States Patent [19]

Kin

[11] 4,449,486

[45] May 22, 1984

[54] COOLING SYSTEM FOR WATER-COOLED ENGINES FOR VEHICLES

[76] Inventor: Chinei Kin, 2-13, Kotobuki-cho 2-chome, Higashi-Osaka-shi, Osaka-fu, Japan

[21] Appl. No.: 498,682

[22] Filed: Jun. 1, 1983

Related U.S. Application Data

[63] Continuation-in-part of Ser. No. 446,026, Dec. 1, 1982, abandoned, which is a continuation-in-part of Ser. No. 214,133, Dec. 12, 1980, abandoned.

[30] Foreign Application Priority Data

Jul. 8, 1980 [JP] Japan ..... 55-97337[U]

[51] Int. Cl.[3] ..... F01D 3.18

[52] U.S. Cl. ..... 123/41.29; 123/41.44

[58] Field of Search ..... 123/41.29, 41.44; 165/51

[56] References Cited

U.S. PATENT DOCUMENTS 1,719,321 7/1929 DeLong ..... 123/41.29
3,425,400 2/1969 Scherenberg ..... 123/41.29

FOREIGN PATENT DOCUMENTS 878798 11/1943 France ..... 123/41.29
2359278 2/1978 France ..... 123/41.29

*Primary Examiner*—William A. Cuchlinski, Jr.
*Attorney, Agent, or Firm*—Armstrong, Nikaido, Marmelstein & Kubovcik

[57] ABSTRACT

A cooling system for a water-cooled engine having a cooling water jacket and installed in a vehicle, includes a cooling unit, an outlet pipe for supplying cooling water from a lower portion of the cooling unit to a lower portion of the jacket of the engine and inlet pipe for feeding the water from an upper portion of the jacket to an upper portion of the cooling unit. At least one auxiliary tank mounted on the vehicle or the like for containing cooling water is connected at a lower portion to the outlet pipe by a lower communication pipe and is also connected at an upper portion to the inlet pipe by an upper communication pipe. The cooling water in the inlet pipe partly flows through the upper communication pipe into the auxiliary tank, while the cooling water in the lower communication pipe joins the cooling water in the outlet pipe. The engine can be cooled with an increased amount of cooling water.

11 Claims, 3 Drawing Figures

COOLING SYSTEM FOR WATER-COOLED ENGINES FOR VEHICLES

This application is a continuation-in-part of application Ser. No. 446,026, filed Dec. 1, 1982, which is a Continuation-in-part of Application Ser. No. 214,133, filed Dec. 12, 1980, now abandoned.

BACKGROUND OF THE INVENTION

The present invention relates to a cooling system for water-cooled engines installed in vehicles.

It is well known that water-cooled engines are universally used for vehicles, such as passenger cars and trucks. Such water-cooled engines are usually provided in front thereof with a cooling unit of the radiator type.

The cooling unit contains cooling water which is forcedly circulated through a channel interconnecting the cooling unit and the engine. The amount of the cooling water is conventionally as small as about 15 to about 16 liters (for 1200–2000 c.c. class in displacement). With use of such an amount of cooling water, the engine deteriorates abnormally rapidly especially during the hot season although operable free of noticeable troubles in the other seasons.

Stated more specifically, if a fully laden vehicle with the above-mentioned cooling water is driven on an upward slope during the hot season, the engine will develop the most serious trouble. Owing to the absolutely insufficient cooling capacity, heat builds up to an abnormal level in the piston-cylinder assembly, markedly impairing the characteristics of the lubricant to promote wear of the piston and cylinder. The enlarged clearance produced results in a lower compression ratio to reduce the power of the engine. The reduced compression ratio leads to impaired ignitability, deteriorates the plug and entails increased fuel consumption. Such problems are detrimental to savings in energy, pollution control and economical maintenance of the vehicle.

These problems are experienced especially with new vehicles and after cylinder boring. To effectively preclude the trouble resulting from the insufficient cooling water, the driver must avoid overloading during driving and break in the vehicle at a reduced speed, but such requirements are liable to be neglected and are fulfilled seldom in practice, so that the engine inevitably deteriorates rapidly.

Further with use of such an amount of cooling water as mentioned above, degradation of the lubricant permits rapid wear on the cylinder, piston, crankshaft and other sliding members of the engine, consequently reducing the endurance and performance of the engine assembly rapidly.

Additionally rust and other foreign matter are produced within the cooling unit in large quantities relative to the amount of the cooling water, with the resulting likelihood of clogging the water channel of the cooling unit to reduced the cooling effect and aggravate the foregoing problems.

Still further, the installation of two cooling units requires an increased space. Since the cooling unit comprises a radiator and a fan which must be driven by drive means, the additional cooling unit must be disposed in the vicinity of the existing cooling unit. Nevertheless, it is difficult to obtain such a large space within the bonnet (hood) of the vehicle. If it is attempted to provide the additional cooling unit outside the hood, an additional drive means needed results in a cost increase.

Thus, it is difficult in respect of space to install two cooling units in usual passenger vehicles. Also the arrangement is costly and, therefore, impractical because the cooling unit itself is so expensive and necessitates the drive means for the fan.

Furthermore, when the temperature of the engine is conventional, there is the need to maintain the piston-to-cylinder clearance at 5/100 mm, but the clearance of 5/100 mm entails a reduced engine output and an increased amount of fuel consumption. If the clearance is 3/100 mm, the engine gives a maximum output and achieves a reduction in the amount of fuel consumption. To enable the engine to rotate properly without seizure at the clearance of 3/100 mm, the engine must be maintained at a temperature of 30° to 50° C., so that it is very critical to maintain the engine temperature at 30° to 50° C.

SUMMARY OF THE INVENTION

An object of this invention is to provide a cooling system having an enhanced cooling capacity with use of a greatly increased amount of cooling water although a limited small amount of water has heretofore been used. The enhanced cooling capacity enables the lubricant to fully exhibit its characteristics, eliminating the problem that the piston-to-cylinder clearance, if increased, would permit a leak of gas to result in a lower compression ratio and thereby assuring effective and stable ignition and greatly improved fuel consumption efficiency. The enhanced cooling capacity further prevents the plug from overheating, effectively reduces the consumption of fuel and renders the plug serviceable for a prolonged period of time.

Another object of the invention is to provide a cooling system of greatly increased cooling capacity to adapt an engine for intense and stable ignition and eliminate the necessity for breaking-in running needed for new vehicles and cylinder boring, enabling the engine to exhibit very tough performance even under severe conditions and achieve a high initial fuel consumption efficiency for economical running.

Another object of the invention is to provide a cooling system by which cylinders, pistons, circulating lubricant and the portions to be cooled with the circulating lubricant can be cooled more effectively than heretofore possible to render the sliding surfaces free of degradation due to heat and give improved endurance to the engine. When thus effectively cooled, the lubricant exhibits its characteristics to full extent, affording high durability to the piston-crankshaft assembly and other engine parts and permitting the engine to achieve improved performance.

Still another object of the invention is to provide a cooling system which uses an increased amount of water so that rust and other foreign matter formed can be diluted to prevent clogging of the water channel of the system and thereby assure circulation of the water, the cooling system thus being adapted to achieve a high cooling effect at all times.

Another object of the invention is to provide a cooling system which is simple in construction and which can be installed in various locations at a low cost and easily. Another object of the invention is to provide a cooling system for maintaining the engine at a temperature of 30° to 50° C. to thereby make it possible to maintain the piston-to-cylinder clearance at 3/100 mm and assure a higher compression ratio and reduced fuel consumption.

Another object of the invention is to provide a cooling system wherein the rate of flow of cooling water is controlled by a valve for controlling the temperature of the engine.

Another object of the invention is to provide a cooling system by which the temperature of the engine is controllable at the driver's seat.

Another object of the invention is to provide a cooling system for automatically controlling the temperature of the engine.

DETAILED DESCRIPTION OF THE INVENTION

Figure 1:
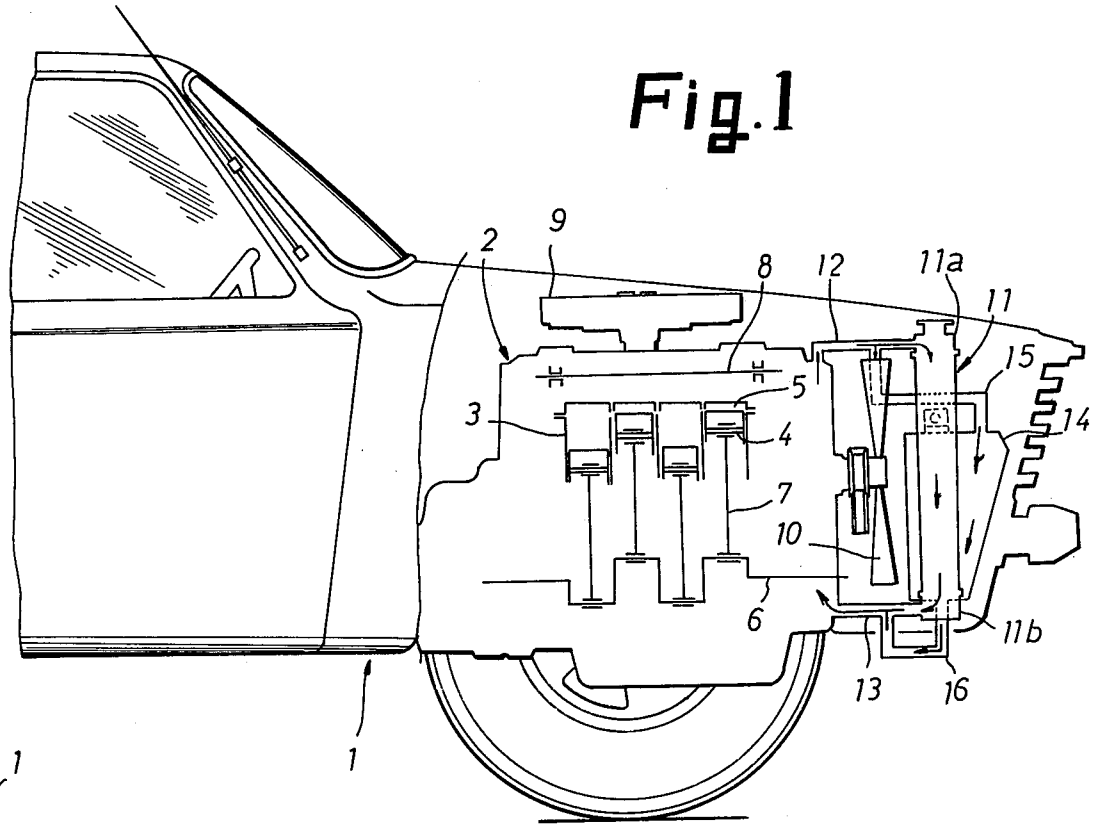
FIG. 1 is a side elevation schematically showing an embodiment of this invention as adapted for use in a usual passenger car.
Figure 2:
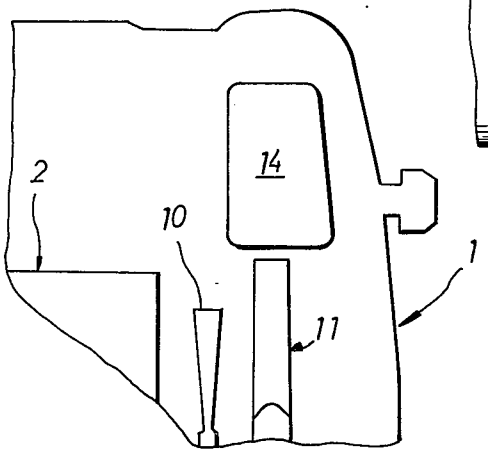
FIG. 2 is a plan view showing the front left portion of the same.

With reference to FIGS. 1 and 2, a vehicle 1 has an engine 2 installed therein. As in well known, the engine is multi-cylindered and includes cylinders 3 having pistons 4 and combustion chambers 5 in their upper portions. The engine has at its lower portion a crankshaft 6 extending logitudinally thereof and supported rotatably. The shaft 6 is connected to the pistons 4 by connecting rod 7. The engine further has a rocker-arm shaft 8 and an air cleaner 9.

Disposed in front of the engine 2 is a cooling fan 10 rotatable by the crankshaft 6. In front of the fan there is a cooling unit 11 of the radiator type having an upper tank **11*a* and a lower tank 11*b*. The upper tank 11*a* is connected to and held in communication with an upper portion of the cooling water jacket of the engine 2 by an inlet pipe 12. The lower tank 11*b* is connected to and held in communication with a lower portion of the jacket by an outlet pipe 13. The flow channel thus provided has a pump (not shown) by which water serving as the cooling medium is caused to flow from the upper portion of the jacket of the engine 2 through the inlet pipe 12 into the upper tank 11*a* and is cooled in the cooling unit 11. The cooled water flows out from the lower tank 11*b* into the lower portion of the jacket via the outlet pipe 12. Until the water reaches the upper portion of the jacket, the water cools the engine 2**. In this way, the cooling water is circulated.

According to this invention, the cooling unit is provided with auxiliary tanks 14 for promoting cooling. The tank 14 is in the form of a closed box for accommodating the cooling water. In the embodiment shown in FIGS. 1 and 2, the auxiliary tank 14 is disposed on each side of the cooling unit 11. Each of the tanks 14 is connected at a top portion thereof to the inlet pipe 12 by an upper communication pipe 15 in communication with the pipe 12. The bottom of the tank 14 is connected to and held in communication with the outlet pipe 13 by a lower communication pipe 16. The cooling water in the inlet pipe 12 partly flows through the pipe 15 into the auxiliary tank 14. The cooling water in the lower communication pipe 16 joins the water in the outlet pipe 13. The tank 14 releases heat to the atmosphere from its outer surface.

Figure 3:
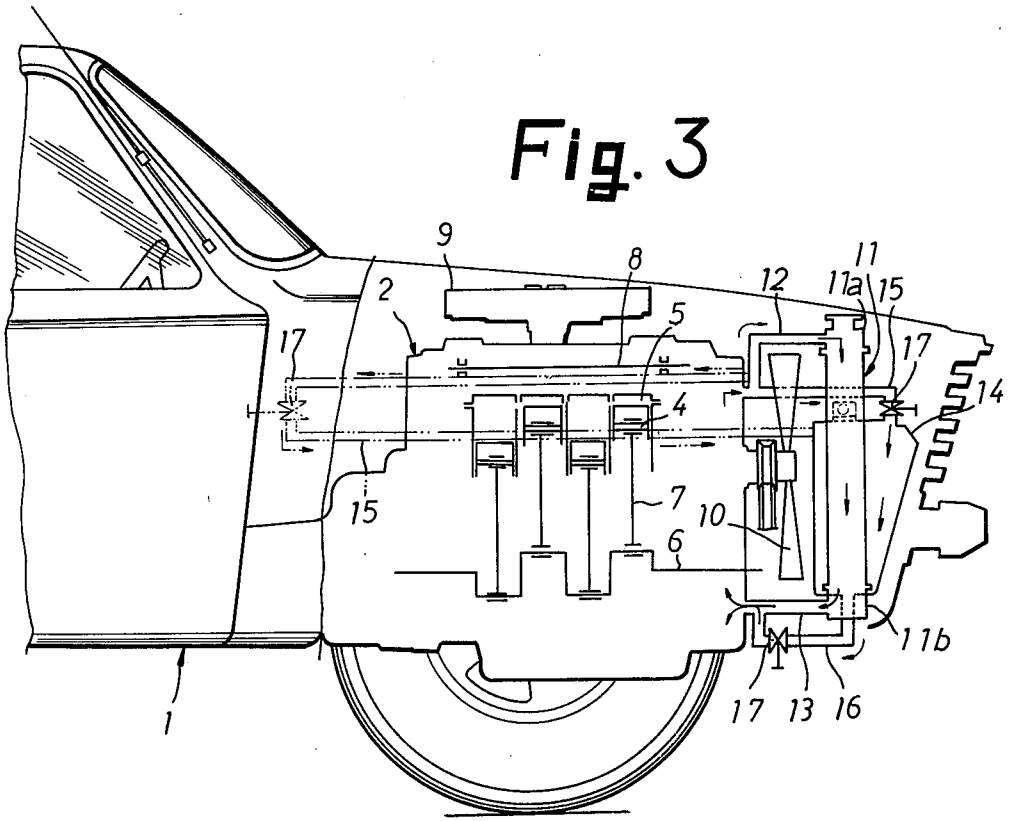
FIG. 3 is a side elevation showing another embodiment.

FIG. 3 shows another embodiment of the invention in which each of the upper and lower communication pipes 15, 16 is provided with a valve 17 for controlling the flow of cooling water. The control valve 17 may be provided on only one of the pipes 15, 16. The valve 17 may be an automatic valve coupled to an unillustrated thermometer mounted on the engine 2 or, alternatively, the valve 17 may be operated manually. Further as indicated in two-dot-and-dash lines in FIG. 3, the upper communication pipe 15 may extend toward the driver's seat with the control valve 17 mounted thereon so that the driver can manually operate the valve. The temperature of the engine 2 can be maintained at a suitable level by altering the degree of opening of the valve 17.

When the control valves 17 of the embodiment are both closed, the auxiliary tank 14 can be mounted on or removed from the vehicle without permitting the leak of the cooling water from the engine 2 or cooling unit 11. The tank is easily replaceable by another auxiliary tank of different capacity.

In the case of the foregoing embodiments, the auxiliary tank 14 may have a capacity of about 20 to about 30 liters, if smallest, for light passenger cars. For larger compact cars, the minimum tank capacity is about 40 to about 60 liters. For such cars, the tank capacity is up to about 100 liters, if largest. The tank capacity is suitably 100 to 150 liters for medium-sized cars. For large-sized cars, such as buses, the tank capacity is suitably about 100 to about 200 liters or larger.

By providing the tank or tanks 14 of the above capacity, the clearance between the cylinder 3 and the piston 4 can be maintained at 3/100 mm. The clearance thus minimized assures an increased compression ratio and an increased engine output, consequently decreasing the fuel consumption conventionally required at a clearance of 5/100 mm.

These approximate values are suitable for usual vehicles in which the piston-to-cylinder clearance is about 5/100. In the illustrated case of specific clearance (about 3/100), approximately twice the above capacity values are suitable in view of the cooling capacity. Suitably the tank capacity is so determined that the engine will have a maximum temperature of about 50° C. and a minimum of about 30° C. even when the vehicle concerned is fully laden and driven up a considerably steep slope during the hottest season of the year, for example, at an atmospheric temperature of 35° C. In addition to the cooling water contained in the auxiliary tanks 14, about 15 to about 16 liters, for example, of cooling water is of course additionally used.

The capacity of the auxiliary tank 14 is determined also in view of the degree of dilution of rust and the like and the degree of release of heat which is dependent on the shape of the auxiliary tank, the length and shape of the upper and lower communication pipes 15, 16, etc.

Such a tank 14 can be provided in any desired portion of the vehicle, for example, in any space within the bonnet (hood) or in the vicinity of the rear fuel tank at the bottom of the trunk, with the top of the tank 14 positioned below the highest water level within the cooling water jacket, within the inlet pipe 12 or within the upper tank **11*a* of the cooling unit 11. The tank 14 is advantageously provided with means that make it easy to fill the tank 14** with cooling water.

The arrangement of the auxiliary tanks 14 is not particularly limited. For example, such a tank may be disposed close to the rear fuel tank. Although the foregoing embodiments have been given as used for passenger vehicles, the cooling system of this invention is similarly useful for diesel engine trucks, ships, compressors and various other devices. The use of the present system is especially indispensable for engines in which heat builds up to a high level due to the use of air conditioners during summer. It is desirable to maintain the engine 2 at a temperature of 30° to 50° C. throughout the year by adjusting the control valves 17. However, when the engine 2 is maintained at a low temperature of 30° to 50° c. to give improved endurance to the engine 2, it may become impossible to use a conventional heater for the driver to which heat is supplied from the engine 2. Hot air may then be supplied to the heater from the hot exhaust pipe of the vehicle.

The present invention described above in detail has the following advantages over the conventional system including two radiators, particularly when the vehicle is fully laden with a conventional cooling water system that is driven on an upward slope during the hot season.

According to the present invention, the temperature of the engine and/or its cooling water are selectively controllable when going up a slope by the use of an increased amount of cooling water by operating the valve or valves thereof, whereas the temperature is not controllable by the conventional system in which fans are used for cooling.

The system of the invention which includes a tank renders the radiator operable free of clogging or plugging whereas the conventional system, which includes two radiators, involves a two-fold likelihood of plugging.

The present system does not consume the power of the battery, while the conventional system uses the battery power for driving the fans.

The tank of the invention is very easy to install, whereas the conventional system requires the skill of special dealer for installation.

The present system can be installed in a desired space of the vehicle. Even if it is installed in the trunk, space therein is available for loading articles, whereas the conventional system is limited in the location of the installation.

Thus the system of the present invention is much less costly.

According to the invention, the temperature of the engine can be maintained at 30° to 50° C. so that the piston-to-cylinder clearance can be reduced to 3/100 mm to given an increased engine output and achieve savings in fuel consumption, whereas the conventional system is limited to a clearance of not smaller than 5/100 mm and requires greater fuel consumption.

The present invention, which permits maintenance of the engine of a temperature of 30° to 50° C., further eliminates the need for breaking-in running which is required for the conventional systems.

What is claimed is:

1. A cooling system for a water-cooled, multicylindered, piston engine having a cooling water jacket for use in a land vehicle, the cooling system comprising a cooling water jacket having a cooling means including a cooling fan and a single radiator with an upper tank and a lower tank, an outlet pipe coupled between the radiator and the cooling water jacket for supplying cooling water from a lower portion of the lower tank to a lower portion of the cooling water jacket, an inlet pipe coupled between the cooling water jacket and the radiator for feeding cooling water from an upper portion of the cooling water jacket to an upper portion of the upper tank, at least one auxiliary tank in the form of a closed box containing cooling water capable of being circulated in parallel with the radiator, the tank being adapted to release heat to the atmosphere from its outer surface without a fan and having a capacity to selectively maintain the engine cooling water at a temperature of between about 30° C. to about 50° C. by selectively additionally using at least between about 15 to about 16 liters of cooling water in a parallel flow with the radiator selectively to afford an increased amont of cooling water in a flow to the water jacket when going up a slope, a lower communication pipe means connecting a lower portion of the auxiliary tank to the outlet pipe such that the cooling water in the lower communication pipe means flows into the outlet pipe and mixes with the cooling water in the outlet pipe, and an upper communication pipe means connecting the inlet pipe to an upper portion of the auxiliary tank such that a portion of the cooling water in the outlet pipe flows through the upper communication pipe means into the auxiliary tank, and wherein at least one of the upper and lower communication pipe means is provided with a water valve for selectively controlling the flow of cooling water therethrough when going up a slope, and said auxiliary tank is capable of being in parallel with the radiator so as to selectively circulate the cooling water from the cooling water jacket directly to the top of the radiator and then back to the cooling water jacket in a first cooling water path, and also from the cooling water jacket to the top of the box and then back to the cooling water jacket in a second cooling water path.

2. A cooling system as defined in claim 1 wherein a tank is provided in a front space within the bonnet of the engine.

3. A cooling system as defined in claim 2 wherein a tank is provided on each side of the radiator or at another location of the vehicle.

4. A cooling system as defined in claim 1 wherein the top of the tank is positioned below the highest water level within the cooling water jacket, within the inlet pipe or within the cooling unit.

5. A cooling system as defined in claim 4 wherein the capacity of the tank is about 40 to about 60 liters when the vehicle is a car having a piston displacement of between about 1200–2000 cc's.

6. A cooling system as defined in claim 5 wherein a valve is provided on each of the lower and upper communication pipe means, the pipe means being detachably connected to the valve, the tank being removably mounted on the vehicle.

7. A cooling system as defined in claim 6 wherein the valve is accessible when the vehicle is in operation.

8. A cooling system as defined in claim 7 wherein the valve is a manual valve.

9. A cooling system as defined in claim 8 wherein the valve is a control valve for controlling the piston-to-cylinder clearance to be below about 3/100 mm during the operation of the vehicle by maintaining the engine cooling water temperature at between about 30° to 50° C.

10. A cooling system as defined in claim 4 wherein the vehicle is a bus having a tank whose capacity is at least up to about 200 liters.

11. A cooling system for a water-cooled, multicylindered, piston engine having a cooling water jacket for use in a land vehicle, the cooling system comprising a cooling water jacket having a cooling means including a cooling fan and a single radiator with an upper tank and a lower tank, an outlet pipe coupled between the radiator and the cooling water jacket for supplying cooling water in a flow from the lower portion of the lower tank to a lower portion of the cooling water jacket, an inlet pipe coupled between the cooling water jacket and the radiator for feeding cooling water in a flow from an upper portion of the cooling water jacket to an upper portion of the upper tank, at least one auxiliary tank in the form of a closed box containing cooling water capable of being circulated in a parallel flow with the flow in the radiator, the tank being adapted to release heat to the atmosphere from its outer surface without a fan and having a capacity to selectively maintain the engine cooling water at a temperature of between about 30° C. to about 50° C. by selectively adding at least about 15 to about 16 liters of cooling water in a parallel flow with the flow in the radiator to afford an incrased amount of cooling water in a flow to the water jacket, a lower communication pipe means connecting a lower portion of the auxiliary tank to the outlet pipe such that the cooling water in the lower communication pipe means flows into the outlet pipe and mixes with the cooling water in the outlet pipe, and an upper communication pipe means connecting the inlet pipe to an upper portion of the auxiliary tank such that a portion of the cooling water in the outlet pipe flows through the upper communication pipe means into the auxiliary tank, at least one of said upper and lower communication pipe means being provided with a water valve for selectively controlling the flow of cooling water therethrough, and said auxiliary tank being capable of selectively circulating the water therein in a parallel flow with the cooling water flow in the radiator so as selectively to circulate the cooling water from the cooling water jacket directly to the top of the radiator and then back to the cooling water jacket in a first cooling water path, while also circulating the water from the jacket to the box and then back to the cooling water jacket in a second cooling water path, and wherein the capacity of the tank is about 100 to about 150 liters, and wherein the vehicle is a car having a piston displacement range that is larger than the range of between about 1200–2000 cc's.

* * * * *